United States Patent [19]

Grubbs et al.

[11] 4,410,472

[45] Oct. 18, 1983

[54] METHOD FOR MAKING SPHERICAL BINDERLESS PELLETS

[75] Inventors: Donald K. Grubbs, Rector; Andrew T. Kochanowski, Spring Church, both of Pa.

[73] Assignee: Aluminum Company of America, Pittsburgh, Pa.

[21] Appl. No.: 339,323

[22] Filed: Jan. 15, 1982

[51] Int. Cl.[3] ..... C10L 5/00

[52] U.S. Cl. ..... 264/29.3; 44/10 C; 201/6; 502/418

[58] Field of Search ..... 264/29.3, 328.17; 428/402; 44/10 C, 10 K, 10 R; 201/6; 252/421

[56] References Cited

U.S. PATENT DOCUMENTS

| | | | |
|---|---|---|---|
| 2,236,404 | 3/1941 | Herglotz | 44/10 |
| 2,321,238 | 6/1943 | Piersol | 44/10 |
| 2,719,779 | 10/1955 | Brag et al. | 264/29.3 |
| 2,860,957 | 11/1958 | Jones et al. | 44/10 R |
| 2,937,080 | 5/1960 | Komarek et al. | 44/10 |
| 3,093,463 | 6/1963 | Madley | 44/10 |
| 3,232,845 | 2/1966 | Komarek et al. | 44/10 R |
| 3,401,089 | 9/1968 | Friedvich et al. | 264/29.3 |
| 3,492,382 | 1/1970 | Redding et al. | 264/29.3 |
| 3,533,961 | 10/1970 | Voet et al. | 264/29.3 |
| 3,560,346 | 2/1971 | Gunter et al. | 264/29.3 |
| 3,674,449 | 7/1972 | Schmalfeld et al. | 44/10 R |
| 4,050,990 | 9/1977 | Lorenz | 44/10 C |
| 4,111,755 | 9/1978 | Ban et al. | 201/6 |
| 4,156,596 | 5/1979 | Capes et al. | 44/10 C |
| 4,178,215 | 12/1979 | Kiritani et al. | 201/6 |
| 4,181,502 | 1/1980 | Weber et al. | 44/10 C |
| 4,202,734 | 5/1980 | Greenbaum | 44/10 K |
| 4,211,533 | 7/1980 | Nashan et al. | 44/10 C |
| 4,274,836 | 6/1981 | Ban et al. | 44/10 C |

FOREIGN PATENT DOCUMENTS

| | | | |
|---|---|---|---|
| 2643635 | 1/1978 | Fed. Rep. of Germany | 201/6 |

OTHER PUBLICATIONS

"The Application of the Pelletizing Process to the U.S. Coal Industry", by P. T. Luckie and T. S. Spicer, International Briquetting Association Proceedings 1965, pp. 61–75.

"Agglomeration—why and how", by Henry C. Messman, Chemtech, vol. 7, Jul. 1977, pp. 424–427.

Product Data Sheet entitled "Eirich Mixer, Model R7 MPM-System", from Maschinenfabrik Gustav Eirich, D6969 Hardheim, Postfach 45, W. Germany.

*Primary Examiner*—Jay H. Woo

*Attorney, Agent, or Firm*—Max L. Williamson

[57] ABSTRACT

A method for making spherical binderless pellets using a rotating drum mixer whereby at least a portion of the particles comprising the pellets is comprised of coking coal particles.

7 Claims, No Drawings

METHOD FOR MAKING SPHERICAL BINDERLESS PELLETS

BACKGROUND OF THE INVENTION

The Government of the United States of America has rights in this invention pursuant to Contract No. DE-AC01-77CS40079 by the Department of Energy.

This invention relates to a method of making essentially spherical pellets comprising at least one coking coal material. More particularly, the pellets are produced without the use of a binder in a rotating drum mixer.

In many uses of carbon or carbonaceous materials it may be advantageous to form the carbon or carbon combined with or without other materials into small compact agglomerates. Coal is widely used as a carbon source because of its generally high carbon content and its abundance as a raw material resource, but many types of coal are difficult to agglomerate which has had a deterrent effect on the utilization of fine coal particles generated during mining and processing of coal.

The oldest and most widely used method of agglomeration of coal is briquetting which comprises forming a shaped block or briquette from the fine coal particles by applying mechanical pressure to the fine particles contained in a mold. Typically, the shape produced by briquetting has been substantially a cube or rectangular prism, such as a brick, and thus the shape has been commonly called a briquette. Usually the method includes the application of heat to the material either before or during forming and the use of a binder in order to achieve satisfactory mechanical properties in the formed shape. A number of methods, however, have been suggested to form briquettes without using a binder, such as Herglotz U.S. Pat. No. 2,236,404, Piersol U.S. Pat. No. 2,321,238, Komarek et al. U.S. Pat. No. 2,937,080, Madley U.S. Pat. No. 3,093,463, to cite but a few.

Binders used in agglomeration of coal may be used as a green strength binder to assist in retaining the particles in an agglomerated form to permit reasonable handling prior to use or processing of the agglomerate, or the binder may provide a relatively high strength bond after agglomeration in applications where the agglomerates are subject to high loads. Binders include such materials as tars, starches or other corn flour products, and lignin solutions which are by-products of the wood pulp paper processing industry. A particle to be agglomerated may also function as a binder. For example, activated alumina is known to have good agglomerating characteristics and may be ball-formed alone or in combination with other particles without using a binder additive. As used herein, the word "binder" means any additive other than water or particles which have inherent agglomerating characteristics such as the aforementioned activated alumina, for example.

Other methods of agglomerating fine coal particles include extruding and balling. Extruding is accomplished by forcing a mixture of fine particles and a binder through a die, usually circular in shape, to produce a rod which is then cut or chopped into short length pellets.

Balling is forming substantially spherical pellets, which hereinafter may be referred to as balls, in a rotating drum or rotating disc. In either method of balling, balls are formed as a natural result of rotating a mass of finely divided particles combined with a liquid. The small balls are formed by a rolling or "snowballing" action in which a small nucleus builds up in size by picking up additional fines as it travels. The exact dynamics that produces the binding strength of the finished green ball is not fully understood, but heretofore the liquid medium employed in forming a ball comprised of at least one carbonaceous material has been a binder such as a tar product, corn flour product or lignin solutions which are by-products of the wood pulp paper processing industry. Addition of such binders has been considered necessary in making ball products having carbonaceous materials therein in order to develop sufficient green strength for handling and transporting the balls. As may be noted in "Chemistry of Coal Utilization, Second Supplementary Volume", Martin A. Elliot, Editor, at page 661, fuel pellets agglomerated with water do not have great strength and cannot withstand major stresses during transport or when subjected to high loads. Consequently, to increase the strength of the pellets inorganic binders are often added.

Forming pellet-sized objects by ball forming rather than by briquetting is advantageous. For example, ball forming is economically attractive in comparison to briquetting because it eliminates the need for pressure molding equipment and yields higher production rates. Also, balls or substantially spherical agglomerates are more free-flowing than typically shaped briquettes and thus are better suited for handling and less susceptible to breakage and abrasive wear. The limiting feature in the wider usage of spherical pellets has been the lower mechanical strengths attainable in forming the pellets.

It would be desirable, therefore, to provide a method for making a substantially spherical binderless pellet from carbonaceous materials.

SUMMARY OF THE INVENTION

The present invention is directed to a binderless method of forming particles comprised of at least a coking coal material and a noncoking material into substantially spherical carbonized pellets. A mixture of coking coal and other noncoking material particles is combined with water in a countercurrent drum-type mixer to form agglomerated balls. The balls are then air-dried to drive off excess water. The balls at this stage have a relatively low green strength and, to develop a relatively high ultimate strength, are heated at a temperature sufficient to carbonize the coking coal.

In the practice of this invention at least one of the materials in the mixture is a coking coal; that is, a coal having the requisite plasticity, swelling, caking characteristics, etc., to be considered as a coking coal to one skilled in the art, and at least one of the materials must have noncoking characteristics. It is not necessary that the particles are completely dry but they must be essentially dry; that is, capable of being uniformly distributed by mixing without agglomerating. It is preferred that at least a portion of the particles have a mesh size less than 100 (Tyler Series), and more preferably less than 200, since it is believed that fine particles assist in promoting ball formation.

The particulate materials are charged into a countercurrent drum-type mixer, and after mixing a long enough time to uniformly distribute the coking and noncoking particles throughout the mixture, water is added gradually to the particles while continuing the mixing to agglomerate the particles into balls. The total quantity of water added and rate of addition will vary with the initial moisture content of the particles, the particle size of the materials, the types of materials being pelletized and the desired size of the balls to be formed. Mixing is continued as water is added for a sufficient time to produce balls of a desired uniform size.

After the balls are formed as just described, they are discharged from the mixer and are air-dried at a low temperature to drive off excess moisture. They are then heated at a sufficient temperature and time to carbonize the coking coal and produce balls having compressive strengths and abrasion resistance comparable to briquettes or balls formed by using a binder. The particular temperature and time employed in carbonization of the balls are dependent upon the materials comprising the balls and the particular use for which the balls are intended. The compressive strength of the ball derived from carbonization of the coal is relatively much higher than the green strength before carbonization and is hereinafter referred to as the ultimate strength.

It is an object of this invention to provide a method for making balls without the use of a binder, the balls having a coking coal and a noncoking material as at least two of the components. This and other objects and advantages of this invention will be more fully understood from the following description of a preferred embodiment.

DESCRIPTION OF A PREFERRED EMBODIMENT

For the purpose of describing a preferred embodiment of this invention, a method of producing metallurgical coke pellets will be described.

For producing balls suitable for metallurgical purposes by a process of this invention, at least one of the carbonaceous materials must have coking characteristics suitable for producing a coke product having relatively high compressive strengths. It is an advantage of this invention that coking coals and noncoking materials may be combined without the use of a binder to produce a ball having relatively high compressive strengths.

To mix the materials and form the balls, a countercurrent rotating drum-type mixer is employed. In mixers of this kind a drum which serves as the container for the materials to be mixed rotates in one direction. A rotor having a shaft with paddles or other like elements extending outwardly therefrom extends into the drum with the shaft axis parallel to the drum axis. During mixing, the rotor rotates in a direction opposite to the drum and the materials being mixed are thus subject to opposing directions of travel. Mixers of this kind are called, therefore, countercurrent type mixers. Typically the mixer is also provided with a scraper adjacent the wall of the drum to prevent an accumulation and buildup of material along the drum wall. In preparing a preferred embodiment by a method of this invention, a countercurrent mixer, identified as Model No. R7 MPM-System as manufactured by Maschinenfabrik Gustav Eirich, D 6969 Hardheim, Nordbaden, Postfach 45, West Germany, may be used, for example.

The carbonaceous materials to be mixed and pelletized are comprised of at least one coking coal material preferably in a range of 10–60%, and more preferably 30–50%, by dry weight of the essentially dry weight mixture. The coking coal content in the mixture is important, because if there is too little coking coal, there will be an insufficient bond of pellet particles after carbonizing the coking coal, as will be explained later. On the other hand, if the coking coal content is too high, the pellets will fuse together where they contact one another while being carbonized, and the pellets will form a substantially solid mass rather than remaining in a discrete form. The preferred range of 10–60% is not intended to be absolute. It may be seen that since coking coal characteristics may vary considerably depending upon the particular coking coal, the coking coal content in the mixture may be more or less than the 10–60% preferred range. The balance of the mixture may be noncoking materials such as metallurgical and petroleum coke, certain noncoking bituminous, lignite and anthracite coals, for example.

The carbonaceous materials in the above-stated ratios having a particle size of less than 100 mesh (Tyler Series), preferably less than 200 mesh, are charged into the mixer in a substantially dry condition. By substantially dry is meant a condition of dryness that permits a uniform dispersion of the particles without agglomeration into pellets, as will be explained later.

The substantially dry materials are then mixed a time sufficient to uniformly disperse the particles throughout the mixture. After obtaining a uniform dispersion of the particles throughout the mixture, a portion of the dry mixture may be removed and set aside for "dusting off" of the mixture near the end of the ball pellet forming cycle, as will be explained later.

With the mixer operating, water is gradually added to promote the formation of balls. Although the mechanics of the formation of the balls is not fully understood, it is believed that the countercurrent flow of the particles during mixing contributes not only to forming of the balls, but providing sufficient green strength to permit a degree of handling and transport of the balls without fracture or degradation. The water may be added incrementally with a period of mixing following each water addition or the water may be added at a predetermined rate during the course of the ball-forming cycle. Conveniently, the water may be added by a water spray discharging into the drum interior. Water is added to promote the formation of the particles into balls while the drum and rotor are rotated and to provide sufficient green strength to the balls to allow handling of the pellets without serious degradation before carbonization. The amount of water added and the rate of addition is a function of the speed at which the rotor and drum operate, the initial amount of moisture in the substantially dry particles, and the particle size and composition of the carbonaceous material mixture. If the water is added in increments followed by a period of mixing, the mixture may be observed from time to time after each water addition by one skilled in the art of ball forming to determine when each water addition has been utilized in ball formation and the appropriate time to add additional water. In the alternative, the water required to form the desired ball may be added continuously at a predetermined rate based upon prior experience in ball formation of the particular materials involved.

Whether water is added in separate increments or continuously, near the end of the ball-forming cycle the portion of dry material initially removed from the mixer may be utilized to increase the size of the balls or produce balls of more uniform size. Typically, the balls may vary in size in the practice of this invention from approximately $\frac{1}{8}$ inch to $\frac{3}{8}$ inch in diameter. The preferred ball size for this preferred embodiment is $\frac{1}{4}$ inch in diameter to produce a pelletized coke product with suitable compressive strengths and handling characteristics to be used for metallurgical purposes.

At a given rotational drum speed, the ball size may be varied for particular compositions by varying the rotational speeds of the rotor. Generally speaking, operating the rotor at higher speeds results in the formation of smaller balls, and with minimum experimentation one skilled in the art may determine the appropriate operating speeds of the rotor to produce a desired ball size.

After the balls have been formed in the above-described manner, they are discharged from the mixer and are dried at a relatively low temperature, such as 100° C. for example, to drive off excess moisture. They are then heated at a suitable temperature to carbonize the balls into a form-coke product. Since the fluidity, plasticity and other characteristics bearing upon coking vary with different types of coals, the particular temperature and time of carbonization are dependent upon the particular type of coking coal being used in the practice of this invention.

Although a preferred embodiment of this invention has been described as a method of producing coke, the invention is also suitable for forming balls comprised of coking coal and noncarbonaceous materials. For example, pellets comprised of coking coal, metallurgical coke and silica have been formed by a method of this invention. The pellets were then heated to produce silicon carbide.

A number of metals can be produced by reducing their oxides with carbon. Iron and zinc, for example, are produced by processes using coke as a reducing agent in reducing iron and zinc oxides to metallic iron and zinc. It is believed that this invention is suitable for forming pellets comprised of these and other oxides and carbonaceous materials for the purpose of intimately contacting the oxide with carbon and effecting a reduction of the oxide.

The following examples are offered to illustrate the production of ball-shaped pellets by a process of this invention. Examples 1-3 are examples of using a method of this invention to produce form-coke balls. The mixer employed in all of the examples was a model No. R7 MPM-System countercurrent mixer as manufactured by Maschinenfabrik Gustav Eirich, D 6969 Hardheim, Nordbaden, Postfach 45, West Germany. This mixer is adapted to operate at varying rotor speeds to satisfy a range of mixing and pelletizing requirements. In the following examples the mixer was operated at a drum speed of 42 rpm and a rotor speed of 680 rpm, except Example 4, in which example the mixer was operated in a manner that would be known to one skilled in the art to produce an extrusion feed stock.

From analysis of the data generated in the tests performed in the following examples, form-coke pellets made by a process of this invention were observed to have lower compressive green strengths than form-coke briquettes made with equivalent materials. Considering, however, that heretofore carbonaceous materials could not be ball-formed without the use of a binder or the balls formed without the use of a binder could not be handled or transported without severe fracture or degradation, it is surprising that the green strength of balls formed by a process of this invention is sufficient to permit handling and transportation of the balls.

Furthermore, form-coke pellets produced by a method of this invention develop high ultimate compressive strengths which make such pellets suitable for use in many heating and metallurgical applications.

EXAMPLE 1

Thirty-five pounds of substantially dry metallurgical coke and 15 pounds of substantially dry Wharton coal, both materials having a particle size of less than 200 mesh, were charged into the mixer. Wharton coal used in all of the examples is a coking coal having the following characteristics:

| | |
|---|---|
| Mositure, % | 1.52 |
| FC, % | 57.63 |
| VM, % | 34.61 |
| Ash, % | 7.36 |
| Sulfur, % | — |
| FSI | 8.0 |
| Initial Softening Point, °C. | 362 |
| Maximum Fluidity Temperature, °C. | 428 |
| Solidification Temperature, °C. | 479 |
| Gieseler Fluidity, DD/M | 3667 |
| Fluidity Range, °C. | 117 |
| Button Volume, CCS | 9.3 |
| Button Coke Yield, % | 77.5 |

After charging the materials into the mixer, it was operated for approximately 15 seconds which was a time sufficient to cause a uniform dispersion of the coal and coke particles throughout the mixture. Fifteen pounds of the substantially dry mixture were then removed from the mixer and set aside for use in "dusting off" the pellets in the final ball-forming stages.

After removing the 15-pound portion of dry mixture, water was added and the mixer operated with both the drum and rotor operating subsequent to the water addition as follows:

| Water Added | Operating Time After Water Addition |
|---|---|
| 1 liter | 1 min. |
| 500 ml. | ½ min. |
| 500 ml. | ½ min. |
| 500 ml. | ½ min. |
| 1 liter | ½ min. |
| 1 liter | ½ min. |
| 500 ml. | ½ min. |
| 1 liter | 1 min. |

After each water addition and subsequent mixing, the mixer was stopped and the mixture was observed to determine whether the water had been substantially utilized in promoting pellet formation.

After adding water as just described, seven pounds of the 15-pound portion of set-aside dry mixture were added and the rotor and drum operated for five seconds and then the drum only operated for an additional 55 seconds. The remaining eight pounds of set-aside material were then added and the drum and rotor operated for five seconds and the drum only operated for an additional four minutes and 55 seconds.

The balls thus formed were observed to be generally uniform and approximately ¼ inch in diameter and exhibited a generally smooth round surface although they appeared to be slightly damp.

After removal from the mixture, the balls thus formed were dried at a temperature of 105° C. and a representative sample was subjected to a compressive strength test, from which test the average compressive strength of the balls was determined to be 0.10 MPa (Megapascals) or 14 lb/in$^2$.

The remainder of the dried pellets were carbonized at a temperature of 800° C. for three hours to produce form-coke pellets, and a representative sample of the pellets was determined to have an average compressive strength of 0.23 MPa (34 lb/in$^2$).

EXAMPLE 2

A second test was run using the same proportions of coking and noncoking coal as in Example 1. In this example 100 pounds of material were used, the material comprised of 30% by weight Wharton coal and 70% by weight of metallurgical coke.

The materials were charged into the Eirich mixer and mixed for approximately 15 seconds to obtain a uniform dispersion of the particles throughout the mixture. Twenty pounds of the dry mixture were then removed for "dusting off" and water was added in the following quantities with a subsequent mixing time thereafter as follows:

| Water Added | Operating Time After Water Addition |
|---|---|
| 4 liters | 2 min. |
| 2 liters | 2 min. |
| 2 liters | 2 min. |
| 2 liters | 2 min. |
| 1 liter | 2 min. |

Five pounds of dry material were then added and the mixer operated for four minutes thereafter. An additional 5 pounds of dry material were added and the mixer operated for two minutes thereafter. Additional water was then added as follows:

| Water Added | Operating Time After Water Addition |
|---|---|
| 1 liter | 2 min. |
| 1 liter | 4 min. |
| 1 liter | 2 min. |

Five pounds of dry material were added and the mixer was operated for two minutes. Then the remaining five pounds of dry material were added and the mixer was operated for 11 minutes with periodic stopping for observation during that time.

After mixing and forming ball-shaped pellets into approximately ¼ inch diameter balls as just described, one group of the balls were fired at 800° C. and tested to determine that they had an average compressive strength of 131.4 lbs/in$^2$.

The remaining balls were fired at 1000° C. and the average compressive strength of these balls was determined to be 148.3 lb/in$^2$.

The high compressive strengths of the pellets produced in Example 2 led to the conclusion that the pellets of Example 1 having relatively low compressive strengths after carbonizing of the coking coal were not typical of pellets formed by a process of this invention. This conclusion was reinforced by further tests, particularly the test described in the following Example 3. It is not known but is believed that the relatively small increase in compressive strength after firing the pellets produced in Example 1 was due to oxidation of the coking coal before and/or during carbonization.

EXAMPLE 3

In this example substantially dry Wharton coking coal and substantially dry petroleum coke were provided in equal portions with both the coal and coke having a particle size less than 200 mesh. 12.2 kg of coke and 12.2 kg of coal were charged into the mixer and mixed for approximately 15 seconds to obtain a uniform dispersion of the particles throughout the mixture.

Prior to adding water to form pellets, 5 kg of the mixture were removed and set aside for "dusting off" the pellets.

Water was then added in increments and both the rotor and drum were operated for a period of time after each water addition as follows:

| Water Addition | Time of Mixer Operation After Addition |
|---|---|
| 500 ml. | 15 sec. |
| 1000 ml. | 15 sec. |
| 500 ml. | 30 sec. |
| 500 ml. | 15 sec. |
| 500 ml. | 15 sec. |
| 500 ml. | 30 sec. |
| 500 ml. | 60 sec. |
| 500 ml. | 60 sec. |
| 500 ml. | 60 sec. |
| 1000 ml. | 60 sec. |
| 1000 ml. | 60 sec. |
| | 60 sec. (drum operated only) |

After each mixing cycle the mixture was observed to determine whether the added water had been substantially utilized in forming pellets. After mixing with water as noted above, the 5 kg of dusting-off material were added. Two kg were first added and both the drum and rotor operated for five seconds and the drum was then further operated for 55 seconds. The remaining three kg of material were then added with both the drum and rotor operating for five seconds and the drum further operated for four minutes and 55 seconds.

The balls formed were approximately ¼ inch in diameter and were of a generally uniform size. After low temperature drying, a representative sample was tested, and the average dried compressive strength was determined to be 0.07 MPa (10 lb/in$^2$). The remaining balls were heated at 800° C. for one hour to carbonize the coking coal and convert the balls to coke. Representative samples were tested for compressive strengths and the average compressive strength of the tested samples was determined to be 4.92 MPa (714 lb/in$^2$).

An additional representative sample of the carbonized pellets was subjected to an abrasion tumbler test. The pellets having a size range of ⅜"×¼" were weighed and charged into an 8"×7½" steel ball mill having lifters therein spaced 120° apart. The ball mill was operated at 26 rpm for one hour and the contents were then screened to recover pellets retaining a ⅜"×¼" size range and the recovered pellets were then weighed. The difference in weight between the original charge and the recovered pellets represents the weight of pellets lost through abrasion or breakage. This loss was determined to be 53%. A loss of this magnitude is similar to the loss one would expect if briquettes or pellets of like composition but made with a binder were similarly tested.

EXAMPLE 4

For comparative purposes, 9.5 mm×12.5 mm cylindrical pellets comprised of Wharton coking coal and metallurgical coke in various proportions were prepared and tested for compressive strength. The coal and coke materials had a particle size of less than 200 mesh and were uniformly mixed with sufficient water as would be known to one skilled in the art to produce an extrusion feed stock. The feed stock was then placed in an extrusion press and was forced under a pressure of 2000 psi through a 9.5 mm diameter die. The rod produced was then chopped into 12.5 mm lengths. The proportions of coking coal and metallurgical coke, the degree of fusion of the pellets at a carbonizing temperature of 800° C. and the average compressive strengths of the various samples are as follows:

Compressive Strength and Fusion Properties of Fired (800° C.) Coking Coal/Metallurgical Coke Pellets

| Coking Coal, % | Metallurgical Coke, % | Degree of Fusion | Fired Compressive Strength |
|---|---|---|---|
| 10 | 90 | Did not fuse | 0.19 MPA (28 lb/in$^2$) |
| 20 | 80 | Did not fuse | 0.88 MPa (188 lb/in$^2$) |
| 30 | 70 | Did not fuse | 2.06 MPa (299 lb/in$^2$) |
| 40 | 60 | Did not fuse | 3.28 MPa (574 lb/in$^2$) |
| 50 | 50 | Did not fuse | 6.12 MPa (893 lb/in$^2$) |
| 60 | 40 | Fused at contact points of the pellets | 6.56 MPa (952 lb/in$^2$) |
| 70 | 30 | Fused into an agglomerate | ND |
| 80 | 20 | Fused into an agglomerate | ND |
| 90 | 10 | Fused into an agglomerate | ND |

It is believed that pellets formed by a method of this invention and having coking coal and a noncoking constituent as shown above would also have comparable fusion characteristics.

EXAMPLE 5

Example 5 is offered to illustrate that this invention is advantageous in forming ball-shaped pellets having relatively high compressive strengths when combining coking coal with materials other than carbonaceous materials.

In this example, coking coal, metallurgical coke and fused silica were combined to produce a small ball-shaped pellet that was further processed to make silicon carbide. One hundred pounds of dry materials were mixed in an Eirich mixer as described in Example 1 for approximately 15 seconds to uniformly blend and distribute the various particles throughout the mixture. The mixture was comprised of 50% Wharton coking coal, 25% metallurgical coke and 25% fused silica. Particle sizes of the various components were as follows: 20 mesh (Tyler Series) for the coking coal, 50 to 100 mesh for the fused silica, and less than 325 mesh for the metallurgical coke.

After the 15-second dry mixing period, 15 pounds of the mixture were removed for "dusting off" and water was added in the following quantities with a subsequent mixing time as indicated:

| Water Added | Operating Time After Water Addition |
|---|---|
| 5 liters | 3 min. |
| 3 liters | 2 min. |
| 3 liters | 3 min. |
| 2 liters | 3 min. |

Five pounds of dry material were then added and mixed for two minutes. Three pounds of dry material were then added and mixed for eight minutes. Five pounds of dry material were then added and mixed for four minutes. The remaining two pounds of dry material were then added and mixed for four minutes, and then an additional liter of water was added and the mixture was operated for an additional two minutes.

The pellets formed using the above materials and procedures were approximately ¼ inch in diameter and were heated at a temperature of 1000° C. for one hour. The coking coal was carbonized at this temperature and a portion of the pellets were subjected to a compression test and were found to have an average compressive strength of 675 lb/in$^2$.

While the invention has been described in terms of preferred embodiments, the claims appended hereto are intended to encompass other embodiments which fall within the spirit of the invention.

What is claimed is:

1. A method of forming a spherical binderless pellet, comprising:

charging a countercurrent rotating drum mixer with particles of at least one coking material and one noncoking, nonagglomerating material, the size of the coking material including particles having a size which will pass through a 100 mesh (Tyler Series) screen, and mixing said particles for a sufficient time to uniformly disperse said materials throughout a mixture;

adding sufficient water to said particles while mixing to form substantially spherical pellets having a compressive green strength after air drying of at least 10 lb/in$^2$ (0.07 MPa); and heating said pellets at a temperature and for a time sufficient to carbonize said coking coal, the coking coal included in said mixture in an amount effective to bind together the pellet particles without fusing together the pellets at points of contact with one another.

2. The method according to claim 1 wherein said particles are comprised of coking coal particles and noncoking carbonaceous material particles.

3. The method according to claim 1 wherein the particles are comprised of 10% to 60% coking coal by dry weight of the particles and noncoking materials comprise the balance of the particles.

4. The method according to claim 1 wherein the particles are preferably comprised of 30% to 50% coking coal by dry weight of the particles and noncoking materials comprise the balance of the particles.

5. The method according to claim 1 wherein said heating to carbonize is sufficient to convert said coking coal to coke.

6. The method according to claim 1 wherein said temperature is 800° C. to 1000° C.

7. The method according to claim 1 wherein more than 20% of the coking material particles are within a size range of 40 to 150 microns.

* * * * *